US008496998B2

(12) United States Patent
Pickering et al.

(10) Patent No.: US 8,496,998 B2
(45) Date of Patent: Jul. 30, 2013

(54) PRODUCING GLOSS WATERMARK ON RECEIVER

(75) Inventors: Jerry Alan Pickering, Hilton, NY (US); Donald Saul Rimai, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/303,520

(22) Filed: Nov. 23, 2011

(65) Prior Publication Data

US 2013/0129932 A1 May 23, 2013

(51) Int. Cl.
*B05D 5/06* (2006.01)
*B05D 3/12* (2006.01)

(52) U.S. Cl.
USPC ..... 427/472; 427/7; 427/271; 427/370

(58) Field of Classification Search
USPC ..... 427/7, 271, 370, 472
See application file for complete search history.

(56) References Cited

U.S. PATENT DOCUMENTS

| | | | | |
|---|---|---|---|---|
| 4,992,806 | A * | 2/1991 | Peer | 347/54 |
| 5,164,227 | A * | 11/1992 | Miekka et al. | 427/162 |
| 5,581,339 | A | 12/1996 | Jamzadeh et al. | |
| 6,101,345 | A | 8/2000 | Van Goethem et al. | |
| 6,438,336 | B1 | 8/2002 | Bengtson | |
| 6,916,583 | B1 * | 7/2005 | Landa et al. | 430/11 |
| 7,286,685 | B2 | 10/2007 | Brunk et al. | |
| 7,555,139 | B2 | 6/2009 | Rhoads et al. | |
| 2006/0115306 | A1 | 6/2006 | Lofthus et al. | |
| 2006/0290760 | A1 | 12/2006 | German et al. | |
| 2008/0192297 | A1 | 8/2008 | Wang et al. | |
| 2008/0193860 | A1 | 8/2008 | Hains | |
| 2008/0318150 | A1 * | 12/2008 | Agrawal et al. | 430/124.11 |
| 2010/0128321 | A1 | 5/2010 | Wang et al. | |
| 2010/0143841 | A1 | 6/2010 | Stolt et al. | |
| 2010/0151068 | A1 | 6/2010 | Hurst et al. | |
| 2010/0195160 | A1 | 8/2010 | Schulze-Hagenest et al. | |

OTHER PUBLICATIONS

"The History of Information Security, A Comprehensive Handbook," Edited by K. De Leeuw and J. Bergstra, 2007 Elsevier B. V.
Gloss Measurement, Internet at http://www.byk.com/fileadmin/BYK/downloads/support-downloads/instruments/theory/appearance/en/Intro_Gloss.pdf.
U.S. Appl. No. 13/017,260, filed Jan. 31, 2011, Sanger.
U.S. Appl. No. 13/185,846, filed Jul. 19, 2011, Sanger.

* cited by examiner

*Primary Examiner* — Frederick Parker
(74) *Attorney, Agent, or Firm* — Christopher J. White; Peyton C. Watkins

(57) ABSTRACT

A method for producing a gloss watermark includes depositing a heat-softenable marking material onto a receiver. A heatable fixing member is surfaced in a selected region so that the surface roughness of the fixing member in the selected region is different than the surface roughness of the fixing member outside the selected region. The surfaced fixing member is heated. After the deposition step, pressure is applied to the marking-material-bearing portion of the receiver using the heated fixing member, so that the marking material flows and acquires a gloss in a differentiated region on the receiver corresponding to the selected region of the fixing member that is different than the gloss of the marking material outside the differentiated region to create the gloss watermark on the surface of the marking material.

14 Claims, 4 Drawing Sheets

FIG. 4A
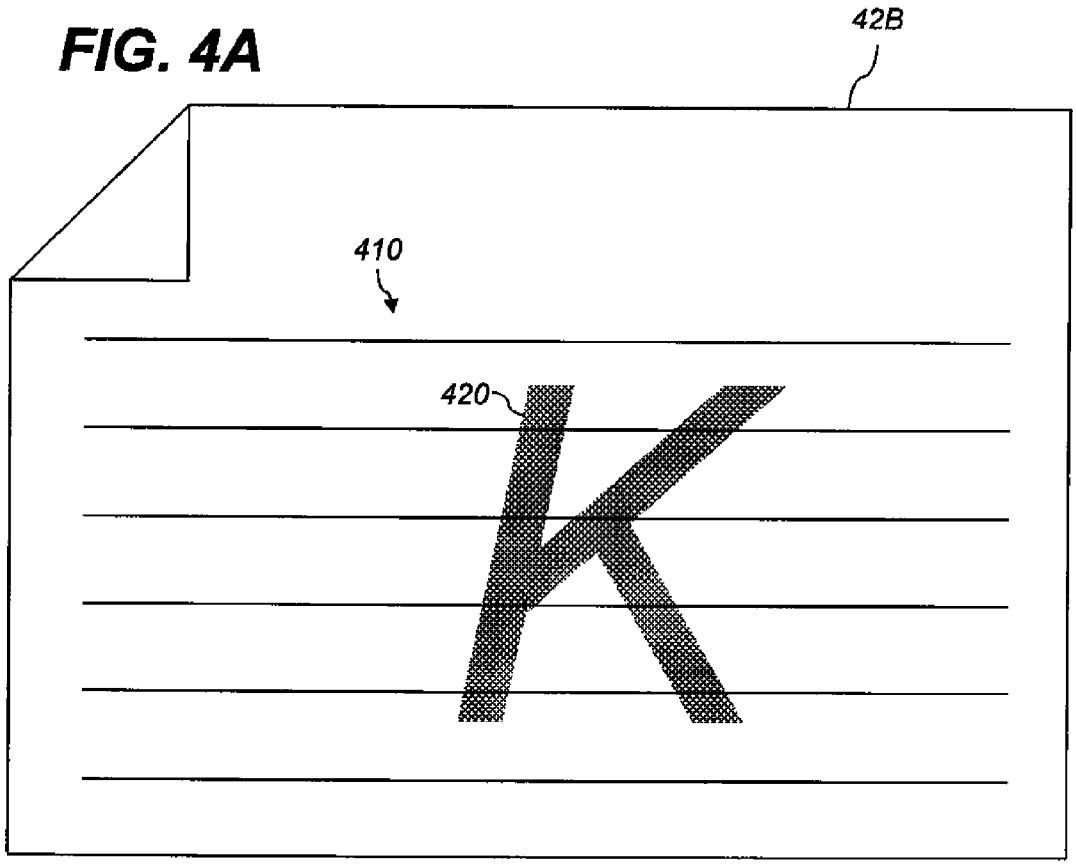
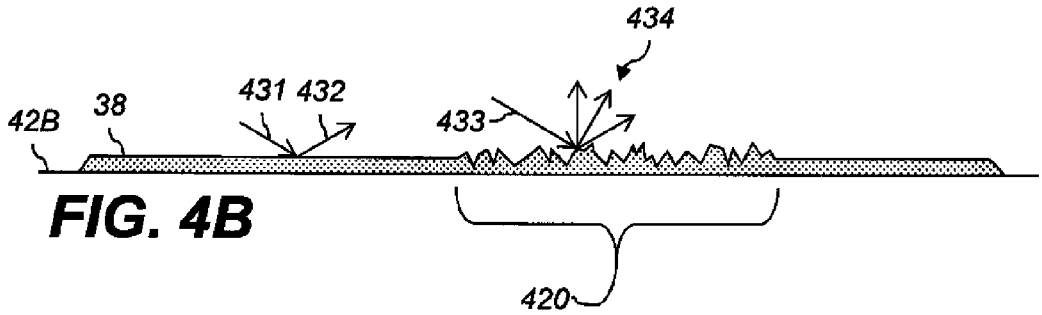
FIG. 4B
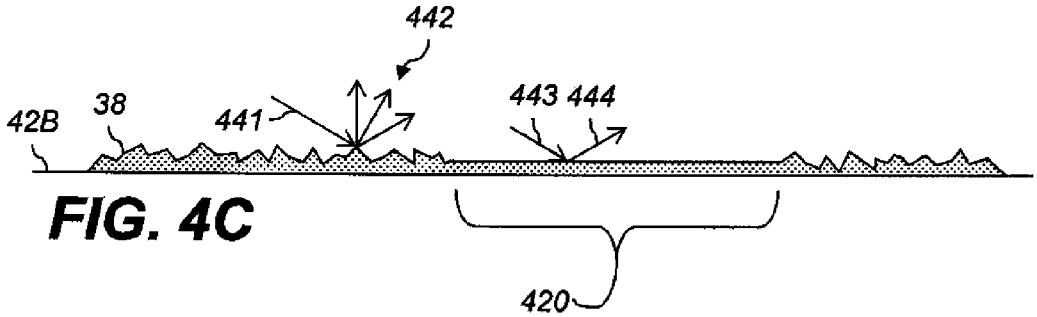
FIG. 4C

PRODUCING GLOSS WATERMARK ON RECEIVER

CROSS-REFERENCE TO RELATED APPLICATIONS

This application is co-filed with and has related subject matter to U.S. patent application Ser. No. 13/303,542, filed herewith, titled "GLOSS-WATERMARK-PRODUCING APPARATUS," which is incorporated herein by reference.

FIELD OF THE INVENTION

This invention pertains to the field of printing and more particularly to producing watermarks on prints.

BACKGROUND OF THE INVENTION

Printers are useful for producing printed images of a wide range of types. Printers print on receivers (or "imaging substrates"), such as pieces or sheets of paper or other planar media, glass, fabric, metal, or other objects. Printers typically operate using subtractive color: a substantially reflective receiver is overcoated image-wise with cyan (C), magenta (M), yellow (Y), black (K), and other colorants. Prints can be produced with various surface finishes such as matte or glossy.

For security, watermarks are often provided on documents that should not be reproduced or counterfeited. A watermark is a pattern visible in the original document under some viewing conditions but not others. For example, cylinder-mold and dandy-roll watermarks vary the thickness of the paper in a pattern corresponding to the watermark. Thinner areas of the paper permit more light to pass through than thicker areas of the paper, so the watermark is visible when backlit. However, the watermark is generally not visible when front-lit. The watermark is therefore not copyable by typical office copiers, flatbed scanners, or devices that image the piece to be copied under front-lit conditions.

However, conventional watermarks require custom paper. In an attempt to provide watermarks that can be produced on standard papers, various schemes have been proposed that modify the image data to be printed. For example, U.S. Patent Publication No. 2008/0192297 describes using anisotropic halftone structures with different orientations to render different parts of an image. This scheme is claimed to provide different gloss characteristics between the parts of the image printed with the different halftone structures. U.S. Patent Publication No. 2008/0193860 describes a similar technique. U.S. Patent Publication No 2010/0128321 describes modulating image content for a contone image according to different polarizations (i.e., halftone screen orientations) to produce differential gloss effects. U.S. Pat. No. 7,555,139 describes adjusting line width or line spacing of a security pattern to carry data. U.S. Pat. No. 7,286,685 describes modifying a stochastic halftone pattern to incorporate a watermark.

However, these schemes require the image data to be modified using specific halftone patterns. Changing halftone patterns changes the appearance of the rendered image in more ways than simply gloss. For example, in a dot screen, the apparent densities of fine lines, as viewed by eye, vary by a certain amount depending on the angle between the line and the screen angle. In a line screen, however, the variation in apparent densities is much more significant. Fine lines substantially parallel to the line-screen angle will appear substantially solid, and fine lines substantially perpendicular to the line-screen angle will appear dotted or dashed. Using a dot screen, in contrast, fine lines either parallel or perpendicular would appear dashed.

Other schemes produce watermarks using specialized watermarking materials. Examples of such materials include colorless toners, colorless ink jet inks, and inks or toners containing specialty materials that are detectable under various instrumentation of special lighting conditions but that are not normally observable to the human eye. Another specialized material is an ink containing a solvent that softens fused toner. This softening changes the gloss of the softened toner. However, these schemes either require special-purpose watermarking machines or occupy space in the printer that could otherwise be used for producing visible images.

There is a continuing need, therefore, for a way of producing a gloss watermark that does not corrupt the intended appearance of the image content, and that permits producing high-quality images without specialized watermarking stations.

SUMMARY OF THE INVENTION

According to an aspect of the present invention, there is provided a method for producing a gloss watermark comprising:

a) depositing a heat-softenable marking material onto a receiver;

b) surfacing a heatable fixing member in a selected region so that a surface roughness of the fixing member in the selected region is different than a surface roughness of the fixing member outside the selected region;

c) heating the surfaced fixing member; and d) after the deposition step, applying pressure to the marking-material-bearing portion of the receiver using the heated fixing member, so that the marking material flows and acquires a gloss in a differentiated region on the receiver corresponding to the selected region of the fixing member that is different than the gloss of the marking material outside the differentiated region to create the gloss watermark on a surface of the marking material.

According to another aspect of the present invention, there is provided a method for producing a gloss watermark comprising:

a) depositing a heat-softenable marking material onto a marking-material-bearing portion of a receiver;

b) surfacing a fixing member in a selected region so that a surface roughness of the fixing member in the selected region is different than a surface roughness of the fixing member outside the selected region; and c) after the deposition step, heating the receiver and applying pressure to the marking-material-bearing portion of the heated receiver using the fixing member, so that the marking material flows and acquires a gloss in a differentiated region on the receiver corresponding to the selected region of the fixing member that is different than the gloss of the marking material outside the differentiated region to create the gloss watermark on a surface of the marking material.

An advantage of this invention is that it provides a gloss watermark without modifying the image content. It does not require a dedicated watermark-imparting machine in addition to the normal components of the printer. It does not occupy a color channel in the printer. It does not require specialty materials. The gloss watermark can be provided on many different papers and other substrates, and does not require custom watermark paper. Producing the watermark does not slow down the printer. Some prior-art schemes require clear toner be deposited to form the gloss watermark, but various embodiments herein can produce a gloss watermark in colored toner, and do not require clear toner.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein:

FIG. 4A is a plan, and FIGS. 4B-4C side views, of a receiver bearing a gloss watermark according to various examples.

Figure 1:
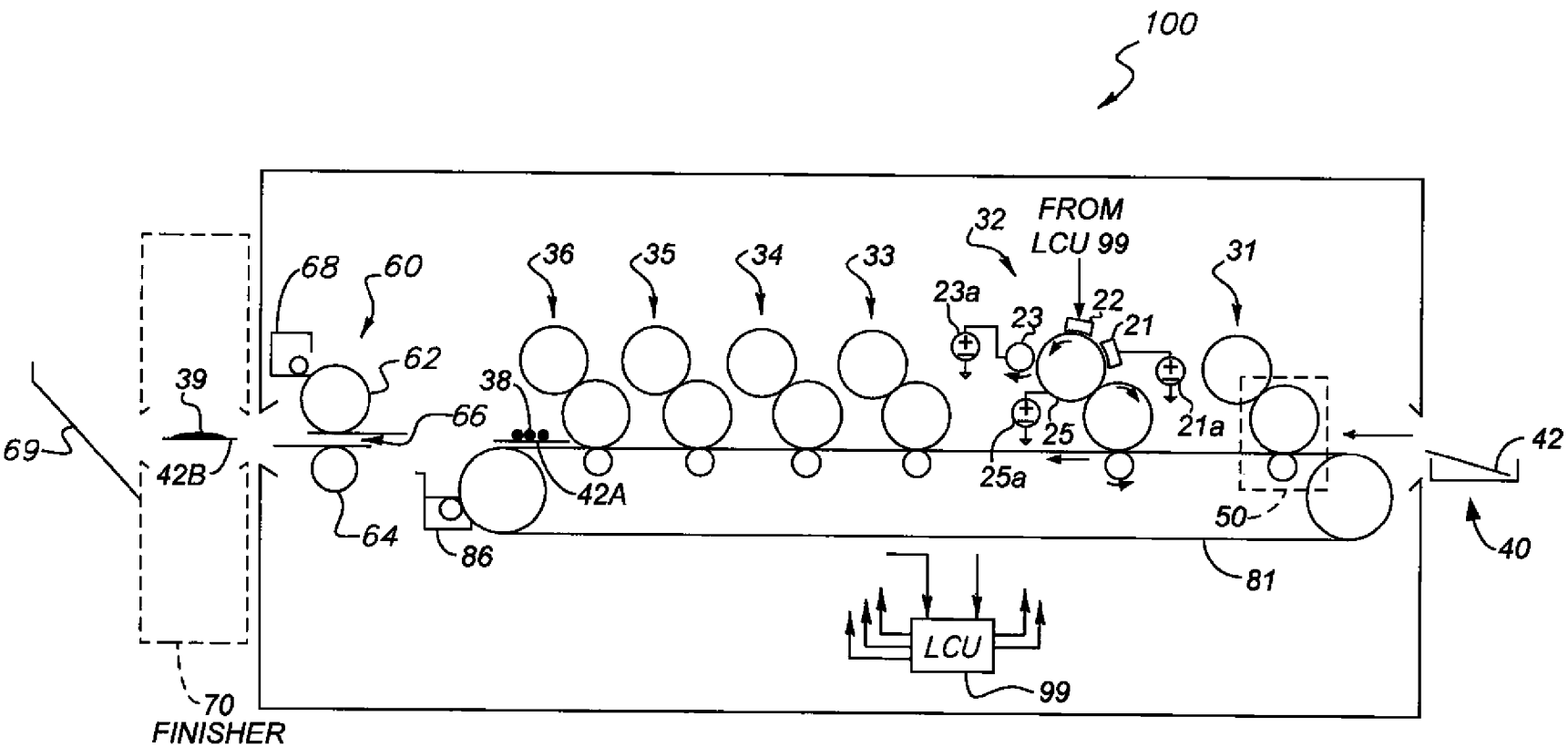
FIG. 1 is an elevational cross-section of an electrophotographic reproduction apparatus.

The attached drawings are for purposes of illustration and are not necessarily to scale.

DETAILED DESCRIPTION OF THE INVENTION

The electrophotographic (EP) printing process can be embodied in devices including printers, copiers, scanners, and facsimiles, and analog or digital devices, all of which are referred to herein as "printers." Electrostatographic printers such as electrophotographic printers that employ toner developed on an electrophotographic receiver are used, as well as ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, or a laminator system). A printer can reproduce pleasing black-and-white or color onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, media type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine, e.g. the NEXPRESS 3000SE printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. As used herein, clear toner is considered to be a color of toner, as are C, M, Y, K, and Lk, but the term "colored toner" excludes clear toners. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective toners are deposited one upon the other at respective locations on the receiver and the height of a respective toner stack is the sum of the toner heights of each respective color. Uniform stack height provides the print with a more even or uniform gloss.

FIG. 1 is an elevational cross-section showing portions of a typical electrophotographic printer 100. Printer 100 is adapted to produce print images, such as single-color (monochrome), CMYK, or hexachrome (six-color) images, on a receiver (multicolor images are also known as "multi-component" images). Images can include text, graphics, photos, and other types of visual content. An embodiment involves printing using an electrophotographic print engine having six sets of single-color image-producing or -printing stations or modules arranged in tandem, but more or fewer than six colors are combined to form a print image on a given receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, 36, also known as electrophotographic imaging subsystems. Each printing module 31, 32, 33, 34, 35, 36 produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver 42, or from an imaging roller to one or more transfer roller(s) or belt(s) in sequence in transfer subsystem 50, and thence to receiver 42. Receiver 42 is, for example, a selected section of a web of, or a cut sheet of, planar media such as paper or transparency film. A receiver can be in sheet or roll form.

Each printing module 31, 32, 33, 34, 35, 36 includes various components. For clarity, these are only shown in printing module 32. Around photoreceptor 25 are arranged, ordered by the direction of rotation of photoreceptor 25, charger 21, exposure subsystem 22, and toning station 23.

In the EP process, an electrostatic latent image is formed on photoreceptor 25 by uniformly charging photoreceptor 25 and then discharging selected areas of the uniform charge to yield an electrostatic charge pattern corresponding to the desired image (a "latent image"). Charger 21 produces a uniform electrostatic charge on photoreceptor 25 or its surface. Exposure subsystem 22 selectively image-wise discharges photoreceptor 25 to produce a latent image. Exposure subsystem 22 can include a laser and raster optical scanner (ROS), one or more LEDs, or a linear LED array.

After the latent image is formed, charged toner particles are brought into the vicinity of photoreceptor 25 by toning station 23 and are attracted to the latent image to develop the latent image into a visible image. Note that the visible image may not be visible to the naked eye depending on the composition of the toner particles (e.g. clear toner). Toning station 23 can also be referred to as a development station. Toner can be applied to either the charged or discharged parts of the latent image.

After the latent image is developed into a visible image on photoreceptor 25, a suitable receiver 42 is brought into juxtaposition with the visible image. In transfer subsystem 50, a suitable electric field is applied to transfer the toner particles of the visible image to receiver 42 to form on the receiver the desired print image, which is composed of marking material 38, as shown on receiver 42A. The imaging process is typically repeated many times with reusable photoreceptors 25.

Receiver 42A is then removed from its operative association with photoreceptor 25 and subjected to heat or pressure to permanently fix ("fuse") marking material 38 of the print image to receiver 42A. Plural print images, e.g. of separations of different colors, are overlaid on one receiver before fusing to form a multi-color print image on receiver 42A.

Each receiver 42, during a single pass through the six printing modules 31, 32, 33, 34, 35, 36, can have transferred in registration thereto up to six single-color toner images to form a pentachrome image. As used herein, the term "hexachrome" implies that in a print image, combinations of various of the six colors are combined to form other colors on receiver 42 at various locations on receiver 42. That is, each of the six colors of toner can be combined with toner of one or more of the other colors at a particular location on receiver 42 to form a color different than the colors of the toners combined at that location. In an embodiment, printing module 31 forms black (K) print images, printing module 32 forms yellow (Y) print images, printing module 33 forms magenta (M) print images, printing module 34 forms cyan (C) print images, printing module 35 forms light-black (Lk) images, and printing module 36 forms clear images.

In various embodiments, printing module 36 forms the print image using a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42A is shown after passing through printing module 36. In these embodiments, marking material 38 on receiver 42A includes unfused toner particles.

Subsequent to transfer of the respective print images, overlaid in registration, one from each of the respective printing modules 31, 32, 33, 34, 35, 36, receiver 42A is advanced to a fixing station 60, i.e. a fusing or fixing assembly, to fuse marking material 38 to receiver 42A. Transport web 81 transports the print-image-carrying receivers (e.g., 42A) to fixing station 60, which fixes the toner particles to the respective receivers 42A by the application of heat and pressure. The receivers 42A are serially de-tacked from transport web 81 to permit them to feed cleanly into fixing station 60. Transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

Fixing station 60 includes a heated fixing member 62 and an opposing pressure member 64 that form a fixing nip 66 therebetween. In an embodiment, fixing station 60 also includes a release fluid application substation 68 that applies release fluid, e.g. silicone oil, to fixing member 62. Alternatively, wax-containing toner is used without applying release fluid to fixing member 62. Other embodiments of fusers, both contact and non-contact, can be employed. For example, solvent fixing uses solvents to soften the toner particles so they bond with the receiver 42. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver 42.

The receivers (e.g., receiver 42B) carrying the fused image (e.g., fused image 39) are transported in a series from the fixing station 60 along a path either to a remote output tray 69, or back to printing modules 31, 32, 33, 34, 35, 36 to create an image on the backside of the receiver (e.g., receiver 42B), i.e. to form a duplex print. Receivers (e.g., receiver 42B) can also be transported to any suitable output accessory. For example, an auxiliary fuser or glossing assembly can provide a clear-toner overcoat. Printer 100 can also include multiple fixing stations 60 to support applications such as overprinting, as known in the art.

In various embodiments, between fixing station 60 and output tray 69, receiver 42B passes through finisher 70. Finisher 70 performs various media-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fixing nip 66 and other operating parameters of fixing station 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Various parameters of the components of a printing module (e.g., printing module 31) can be selected to control the operation of printer 100. In an embodiment, charger 21 is a corona charger including a grid between the corona wires (not shown) and photoreceptor 25. Voltage source 21*a* applies a voltage to the grid to control charging of photoreceptor 25. In an embodiment, a voltage bias is applied to toning station 23 by voltage source 23*a* to control the electric field, and thus the rate of toner transfer, from toning station 23 to photoreceptor 25. In an embodiment, a voltage is applied to a conductive base layer of photoreceptor 25 by voltage source 25*a* before development, that is, before toner is applied to photoreceptor 25 by toning station 23. The applied voltage can be zero; the base layer can be grounded. This also provides control over the rate of toner deposition during development. In an embodiment, the exposure applied by exposure subsystem 22 to photoreceptor 25 is controlled by LCU 99 to produce a latent image corresponding to the desired print image. All of these parameters can be changed, as described below.

Further details regarding printer 100 are provided in U.S. Pat. No. 6,608,641, issued on Aug. 19, 2003, to Peter S. Alexandrovich et al., and in U.S. Publication No. 2006/0133870, published on Jun. 22, 2006, by Yee S. Ng et al., the disclosures of which are incorporated herein by reference.

Figure 2:
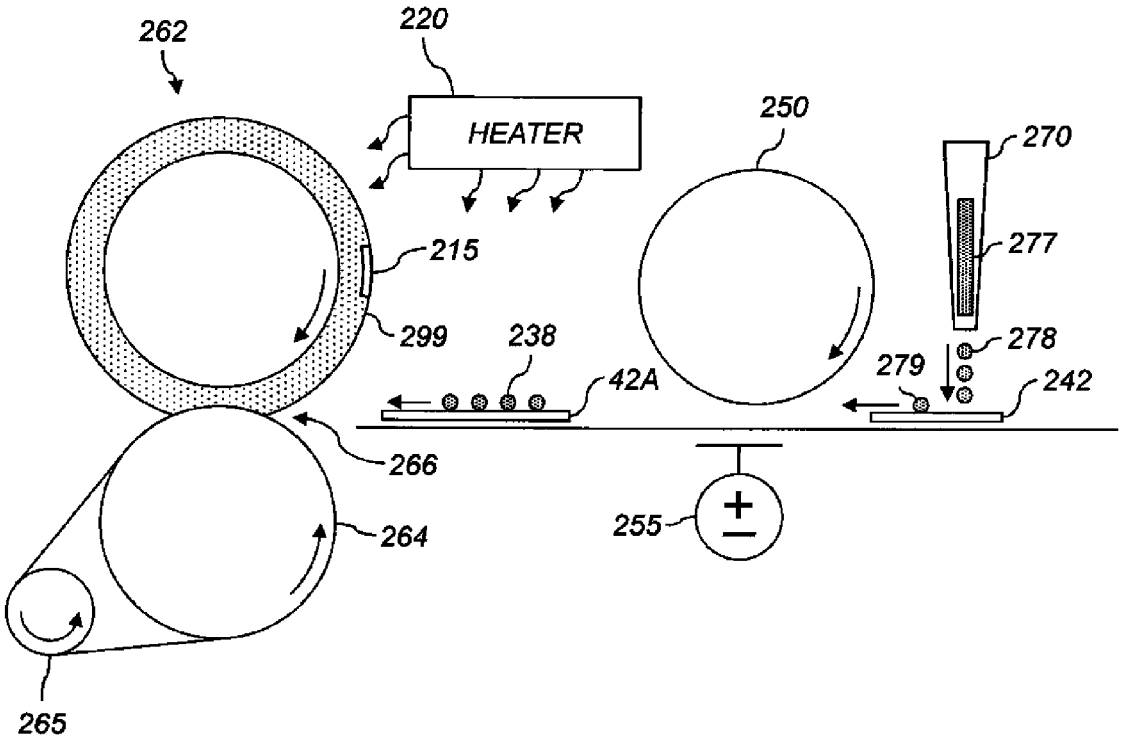
FIG. 2 shows apparatus for producing a gloss watermark on a receiver bearing heat-softenable marking material.

FIG. 2 shows apparatus for producing a gloss watermark on receiver 42A bearing heat-softenable marking material 238.

Rotatable fixing member 262 is surfaced (e.g., texturized, roughened, or smoothed) in selected region 215 so that the surface roughness of fixing member 262 in selected region 215 is different than the surface roughness of fixing member 262 outside selected region 215. The portion of the surface of fixing member 262 outside selected region 215 is surround 299.

Heater 220 selectively heats fixing member 262 or receiver 42A. Heater 220 can be a contact or non-contact heater. It can apply heat, electromagnetic radiation (e.g., infrared light), or time-varying electric or magnetic fields to fixing member 262 or receiver 42A. Marking material 238 is disposed on or over receiver 42A.

Rotatable pressure member 264 is arranged to form fixing nip 266 with fixing member 262. Fixing nips are discussed further above with respect to FIG. 1.

Drive 265 is adapted to rotate fixing member 262 or pressure member 264 to draw receiver 42A through fixing nip 266. Receiver 42A is drawn through fixing nip 266 after fixing member 262 or receiver 42A is heated. As a result, marking material 238 on receiver 42A flows and acquires a gloss in a differentiated region on the receiver corresponding to selected region 215 of fixing member 262. The gloss in the differentiated region is different than the gloss of marking material 238 outside the differentiated region. This creates the gloss watermark on the surface of marking material 238 on receiver 42A; the gloss difference is visible under appropriate illumination. This is discussed further below with respect to FIGS. 4A-4C.

In various embodiments, a marking-material-bearing member 250 transfers the marking material to the receiver. Member 250 can be a belt or drum and can have a rigid or compliant surface. In various embodiments, source 255 produces an electrostatic field that urges marking material 238 from marking-material-bearing member 250 to receiver 42A. Source 255 can provide an AC or DC bias, or both superimposed, either steady or time-varying. In various embodiments, the marking material is or includes toner.

In various embodiments jetting unit 270 jets molten marking material 278 onto receiver 242. Marking material 278 is molten when jetted, and freezes (i.e., cools below its melting temperature) on or shortly after contact with receiver 242 to form solid marking material 279. In various embodiments, jetting unit 270 is a phase change inkjet or hot melt inkjet unit. Solid marking material 277 is supplied to jetting unit 270, which melts solid marking material 277 and jets the resulting molten marking material 278 onto receiver 242. Examples of such systems are provided in U.S. Pat. No. 4,992,806 to Peer, U.S. Pat. No. 4,459,601 to Howkins, and U.S. Pat. No. 4,593,292 to Lewis, all of which are incorporated herein by reference. In these embodiments, fixing member 262 is a spreading member that re-melts solid marking material 279 and applies pressure to level the height profile of the drops of solid marking material 279.

Figure 3:
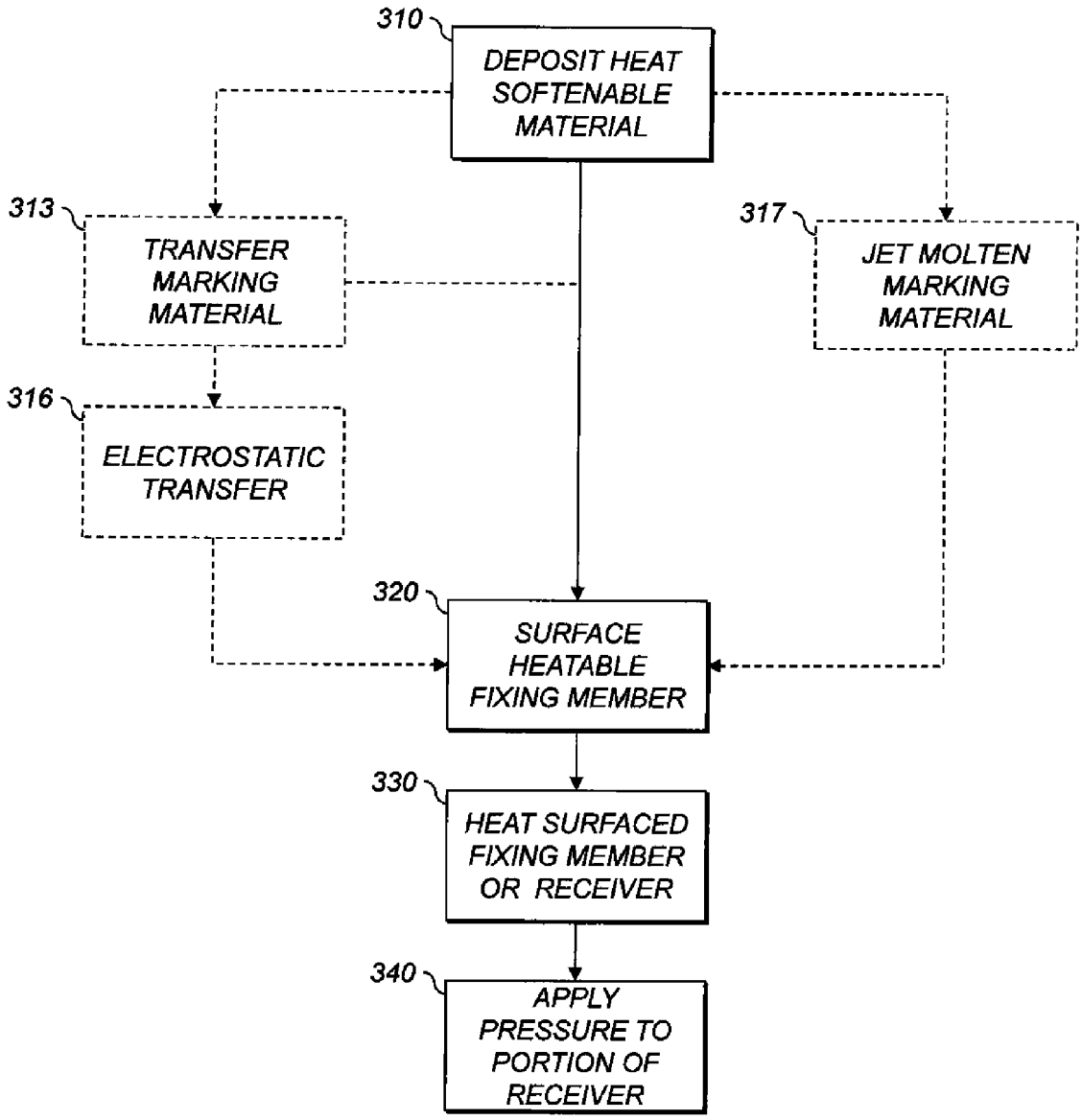
FIG. 3 is a flowchart of various methods for producing gloss watermarks.

FIG. 3 is a flowchart of various methods for producing gloss watermarks. Processing begins with step 310, In step 310, heat-softenable marking material is deposited onto a receiver. In various embodiments, deposition can be performed as described below with reference to steps 313 and 317. Step 310 is followed by step 320.

In optional step 313, in various embodiments, marking material is transferred from a marking-material-bearing member to the receiver. Transfer can be performed mechanically, electrostatically, magnetically, or pneumatically. Step 313 is followed by step 320 or optional step 316.

In optional step 316, in various embodiments, the marking material is transferred by application of an electrostatic field that urges the marking material from the marking-material-bearing member to the receiver. For example, the marking material can be or include toner and the deposition can be performed by electrophotographic printing, as described above with respect to FIG. 1. Step 316 is followed by step 320.

In optional step 317, in various embodiments, molten marking material is jetted onto the receiver. This jetting is performed as discussed above with respect to jetting unit 270 (FIG. 2). Step 317 is followed by step 320.

In step 320, a heatable fixing member is surfaced in a selected region so that the surface roughness of the fixing member in the selected region is different than the surface roughness of the fixing member outside the selected region. The portion of the surface of the fixing member outside the selected region is referred to as the surround, regardless of its size or shape.

The surface roughness of the selected region can be greater or less than the surface roughness of the fixing member in the surround. Surface roughness can be measured in various ways. $R_a$ is the integral of deviations of the surface from a smoothed average surface, or approximately the average. $R_z$ is the average delta between the highest five peaks and the lowest five peaks in sampling length, relative to a smooth averaged surface. $R_{max}$ is the maximum peak to valley in the sampling length, relative to a smooth averaged surface. In various embodiments, for the selected region of the fixing member, the $R_a$ is greater than the $R_a$ of a selected surround region adjacent to the selected region by at least about 1.25 microns, the $R_z$ exceeds that of the surround by at least about 6 microns, and the $R_{max}$ exceeds that of the surround by at least about 8 microns. In various embodiments, for the selected region of the fixing member, the $R_a$ is less than the $R_a$ of the surround by about 1.25 microns or more, the $R_z$ is less than that of the surround by about 6 microns or more, and the $R_{max}$ is less than that of the surround by about 8 microns or more. In various embodiments, for the selected region of the fixing member, $R_a$>0.15 μm, $R_z$ is greater than about 6 μm, and $R_{max}$ is greater than about 8 μm. $R_a$ can be >1.25 μm.

The term "surfaced" used in reference to the fixing member means treating the surface of the fixing member to change its surface roughness. For example, the selected region of the surface of the fixing member can be texturized, roughened, or smoothed. Sandblasting, abrading (e.g., with sandpaper such as Emery A621 paper), chemical etching, polishing (mechanical, chemical, or chemical-mechanical), or buffing can be used to surface the selected region of the fixing member, or the surround. For example, the selected region can be made glossier than the surround by polishing the selected region or by scuffing the surround.

In various embodiments, the fixing member is surfaced by pressing the heated fixing member against an embossing member. The surface of the embossing member includes at least two regions of different roughnesses. As a result, the embossing member imparts a plurality of surface roughnesses to the surface of the fixing member.

In various embodiments, the surface of the fixing member contains a semicrystalline material such as perfluoroalkoxy (PFA). The fixing member is heated to a temperature in excess of that normally used in the fusing process (e.g., up to but not exceeding the melting temperature of the surface material of the fixing member). Upon cooling, the fusing member retains the embossed variable surface roughness.

Step 320 is followed by step 330.

In step 330, the surfaced fixing member or the receiver is heated. An infrared, resistive, or inductive heater can be used to heat the member or receiver directly, or heat can be transferred to the member or receiver from a heat source by a fluid (e.g., hot coolant). Step 330 is followed by step 340.

In step 340, in embodiments heating the fixing member, after the deposition step, pressure is applied to the image bearing portion of the receiver with the heated fixing member. The heat softens the marking material and the pressure causes the softened marking material to flow. As a result, the surface of the marking material visible to a viewer of the printed receiver acquires a certain texture (or lack thereof). This texture provides a gloss; smoother marking-material surfaces generally have higher gloss than rougher surfaces. Since the fixing member has the selected region, a gloss is imparted to the marking material in a differentiated region on the receiver corresponding to the selected region of the fixing member that is different than the gloss of the marking material outside the differentiated region. This gloss difference creates the gloss watermark on the surface of the marking material.

In step 340, in embodiments heating the receiver, after the deposition step 310, the receiver is heated so that the marking material on the receiver softens. As discussed above, pressure is applied to the marking-material-bearing portion of the heated receiver with the fixing member, so that the marking material flows and acquires a gloss in a differentiated region on the receiver corresponding to the selected region of the fixing member that is different than the gloss of the marking material outside the differentiated region to create the gloss watermark on the surface of the marking material.

Some of these steps can be performed in various orders. For example, in various embodiments, the fixing member is surfaced (step 320) first. The surfaced fixing member is then heated (step 330). Heat-softenable marking material is deposited (step 310), and then pressure is applied to the receiver with the heated fixing member (step 340). In general, the fixing member is surfaced before pressure is applied.

FIG. 4A is a plan of receiver 42B bearing a gloss watermark according to an example. Image content 410, represented graphically as a series of parallel lines, is the non-gloss-watermark content of the print. In an example, image content 410 includes all the marking material deposited on receiver 42B, considered without regard to viewing angle. In this example, image content 410 is also present between the parallel lines. For clarity, this content is not depicted.

Differentiated region 420 is a region on receiver 42B in which marking material 238 (FIG. 2) has a particular gloss. The gloss of marking material 238 in differentiated region 420 is different than the gloss of the marking material outside differentiated region 420. This difference creates the gloss watermark on the surface of marking material 238: at certain viewing angles, the difference in gloss is visible, and the shape of differentiated region 420 can be seen. Differentiated region 420 corresponds to selected region 215 (FIG. 2) of fixing member 262 (FIG. 2). The area outside differentiated region 420 corresponds to surround 299. The marking material can be the marking material of image content 410, or can be clear or other marking material deposited for use in forming the gloss watermark.

FIG. 4B is a side view of receiver 42B. In this example, the gloss of marking material 238 in differentiated region 420 is less than the gloss of marking material 238 outside differentiated region 420. Ray 431 shows the path of incident light from a 60° glossmeter. Ray 432 shows the path of the reflected light. Outside differentiated region 420, the reflection is largely specular, and the surface has high gloss. Inside differentiated region 420, incident ray 433 results in diffuse-reflection (rays 434). The surface has low gloss.

FIG. 4C is a side view of receiver 42B. In this example, the gloss of marking material 238 in differentiated region 420 is greater than the gloss of marking material 238 outside differentiated region 420. Outside differentiated region 420, incident ray 441 produces diffuse-reflection rays 442. Inside differentiated region 420, incident ray 443 produces specularly-reflected ray 444. The gloss of the surface inside differentiated region 420 (specular reflection) is higher than the gloss outside (diffuse reflection).

In various embodiments, differentiated region 420 occupies more than 25% of the area of the receiver. In various embodiments, the differentiated region includes multiple disconnected segments.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

| | |
|---|---|
| 21 | charger |
| 21a | voltage source |
| 22 | exposure subsystem |
| 23 | toning station |
| 23a | voltage source |
| 25 | photoreceptor |
| 25a | voltage source |
| 31, 32, 33, 34, 35, 36 | printing module |
| 38 | marking material |
| 39 | fused image |
| 40 | supply unit |
| 42, 42A, 42B | receiver |
| 50 | transfer subsystem |
| 60 | fixing station |
| 62 | fixing member |
| 64 | pressure member |
| 66 | fixing nip |
| 68 | release fluid application substation |
| 69 | output tray |
| 70 | finisher |
| 81 | transport web |
| 86 | cleaning station |
| 99 | logic and control unit (LCU) |
| 100 | printer |
| 215 | selected region |
| 220 | heater |
| 238 | heat-softenable marking material |
| 242 | receiver |
| 250 | marking-material-bearing member |
| 255 | source |
| 262 | fixing member |
| 264 | pressure member |
| 299 | surround |
| 265 | drive |
| 266 | fixing nip |
| 270 | jetting unit |
| 277 | solid marking material |
| 278 | molten marking material |
| 279 | solid marking material |
| 310 | deposit heat-softenable material step |
| 313 | transfer marking material step |
| 316 | electrostatic transfer step |
| 317 | jet molten marking material step |
| 320 | surface heatable fixing member step |
| 330 | heat surfaced fixing member or receiver step |
| 340 | apply pressure to portion of receiver step |
| 410 | image content |
| 420 | differentiated region |
| 431, 433, 441, 443 | incident light ray |
| 432, 444 | specularly-reflected ray |
| 434, 442 | diffuse-reflection ray |

The invention claimed is:

1. A method for producing a gloss watermark comprising:

a) depositing a selected pattern of a heat-softenable marking material onto a marking material-bearing portion of a receiver;

b) surfacing a heatable fixing member in a selected region so that a surface roughness of the fixing member in the selected region is different than a surface roughness of the fixing member outside the selected region;

c) heating the surfaced fixing member;

d) after the deposition step, applying pressure to the marking-material-bearing portion of the receiver using the heated fixing member, so that the marking material flows and acquires a gloss in a differentiated region on the receiver corresponding to the selected region of the fixing member that is different than the gloss of the marking material outside the differentiated region; and e) creating a watermark on a surface of the marking material that is visible in specular reflection and not visible under diffuse lighting conditions due to the gloss difference.

2. The method according to claim 1, wherein the depositing step includes transferring the marking material from a marking-material-bearing member to the receiver.

3. The method according to claim 2, wherein the marking material is transferred by application of an electrostatic field that urges the marking material from the marking-material-bearing member to the receiver.

4. The method according to claim 2, wherein the marking material includes toner.

5. The method according to claim 1, wherein the depositing step includes jetting molten marking material.

6. The method according to claim 1, wherein the gloss of the marking material in the differentiated region is less than the gloss of the marking material outside the differentiated region.

7. The method according to claim 1, wherein the gloss of the marking material in the differentiated region is greater than the gloss of the marking material outside the differentiated region.

8. The method according to claim 1, wherein the differentiated region occupies more than 25% of the area of the receiver.

9. The method according to claim 1, wherein the differentiated region includes multiple disconnected segments.

10. A method for producing a gloss watermark comprising:

a) depositing a selected pattern of a heat-softenable marking material onto a marking-material-bearing portion of a receiver;

b) surfacing a fixing member in a selected region so that a surface roughness of the fixing member in the selected region is different than a surface roughness of the fixing member outside the selected region;

c) after the deposition step, heating the receiver and applying pressure to the marking-material-bearing portion of the heated receiver using the fixing member, so that the marking material flows and acquires a gloss in a differentiated region on the receiver corresponding to the selected region of the fixing member that is different than the gloss of the marking material outside the differentiated region to create the gloss watermark on a surface of the marking material; and d) creating a watermark on a surface of the marking material that is visible in specular reflection and not visible under diffuse lighting conditions due to the gloss difference.

11. The method according to claim 10, wherein the depositing step includes transferring the marking material from a marking-material-bearing member to the receiver.

12. The method according to claim 11, wherein the marking material is transferred by application of an electrostatic field that urges the marking material from the marking-material-bearing member to the receiver.

13. The method according to claim 11, wherein the marking material includes toner.

14. The method according to claim 10, wherein the depositing step includes jetting molten marking material.

* * * * *